United States Patent [19]

Tene

[11] Patent Number: 4,907,390

[45] Date of Patent: Mar. 13, 1990

[54] TRUSS MODULE FOR LOAD-BEARING STRUCTURES

[76] Inventor: Yair Tene, 4 Mapu Blvd., Haifa 34361, Israel

[21] Appl. No.: 332,144

[22] Filed: Apr. 3, 1989

Related U.S. Application Data

[63] Continuation-in-part of Ser. No. 145,159, Jan. 19, 1988, Pat. No. 4,827,688.

[51] Int. Cl.[4] ..... E04C 3/30

[52] U.S. Cl. ..... 52/694; 52/592; 52/696; 52/732

[58] Field of Search ..... 52/648, 646, 690, 693, 52/694, 729, 730, 731, 732, 738, 696, 592

[56] References Cited

U.S. PATENT DOCUMENTS

| | | | |
|---|---|---|---|
| 1,911,018 | 5/1933 | Goeltz | 52/648 |
| 2,089,023 | 8/1937 | Hahn | 52/694 |
| 2,114,901 | 4/1938 | Henderson | 52/732 X |
| 4,461,134 | 7/1984 | Lowe | 52/732 |
| 4,827,688 | 5/1989 | Tene | 52/694 |

FOREIGN PATENT DOCUMENTS

| | | | |
|---|---|---|---|
| 137914 | 2/1934 | Fed. Rep. of Germany | 52/592 |
| 393823 | 11/1908 | France | 52/694 |
| 129723 | 7/1919 | United Kingdom | 52/696 |

*Primary Examiner*—Richard E. Chilcot, Jr.
*Attorney, Agent, or Firm*—Benjamin J. Barish

[57] ABSTRACT

A modular constructional element comprises a truss including first and second longitudinally-extending bars joined by a plurality of transversely-extending bars such that the transversely-extending bars all occupy a first plane, and the first and second longitudinally-extending bars occupy second and third planes on opposite sides of the first plane. One of the longitudinally-extending bars has a substantial width in its respective plane to serve as a deck member in a construction utilizing a plurality of such modular elements. Such modular elements are useful in constructing various types of load-bearing structures, particularly bridges, since they are self-nesting and thereby decrease the volume for shipping, storing and handling, and also obviate the need for separate containers.

12 Claims, 7 Drawing Sheets

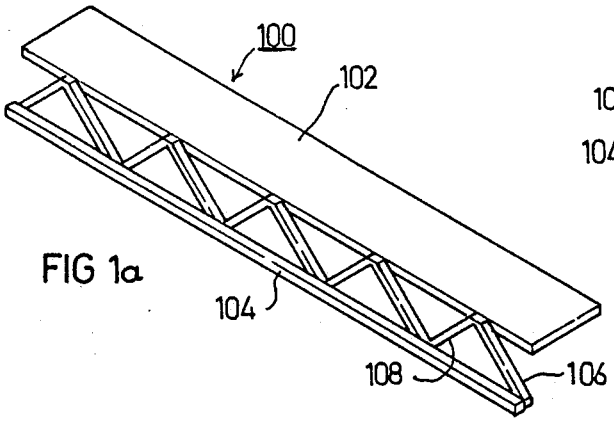
FIG 1a
FIG 1b
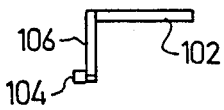
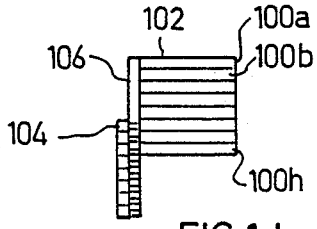
FIG 1d
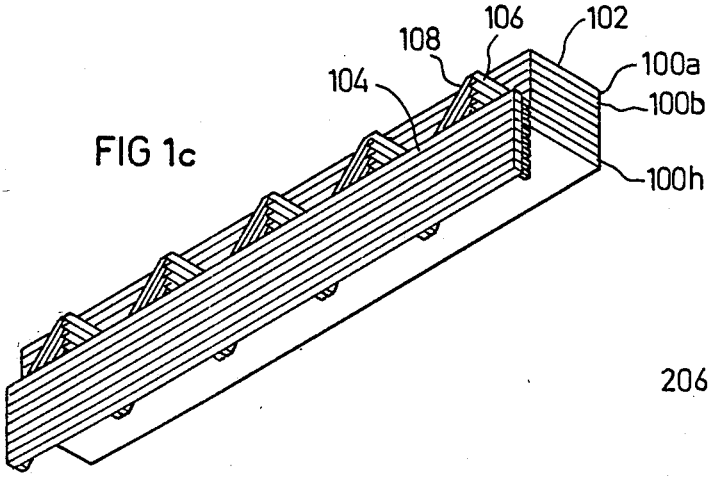
FIG 1c
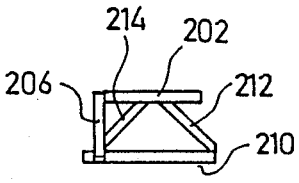
FIG 2b
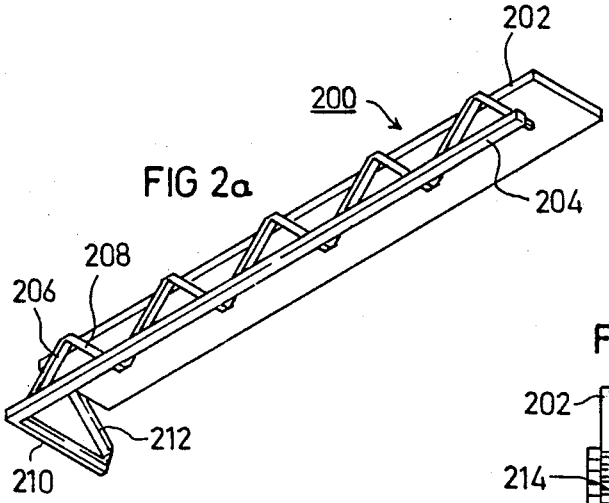
FIG 2a
FIG 2d
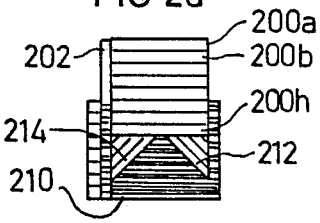

FIG 2c
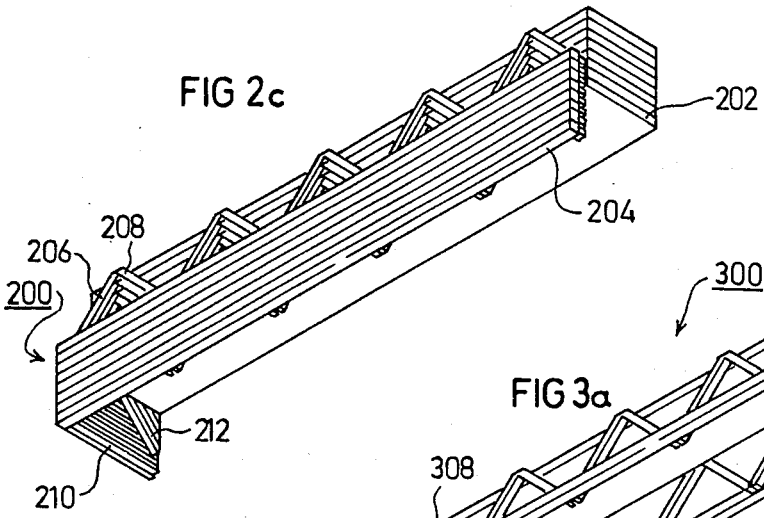
FIG 3a
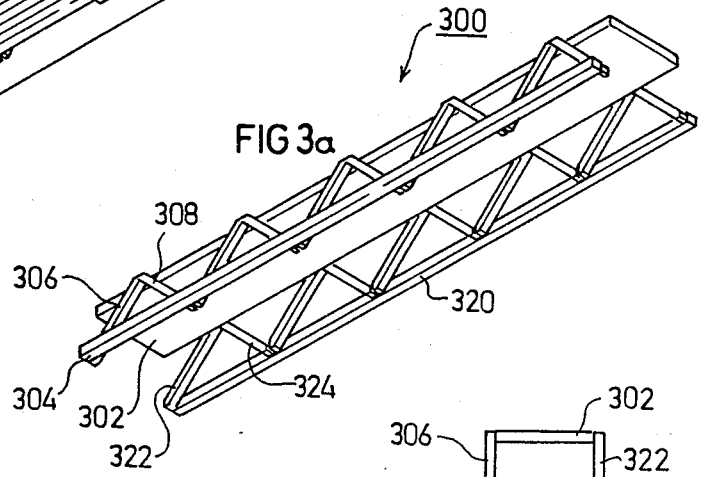
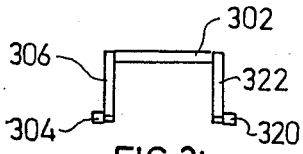
FIG 3b
FIG 3c
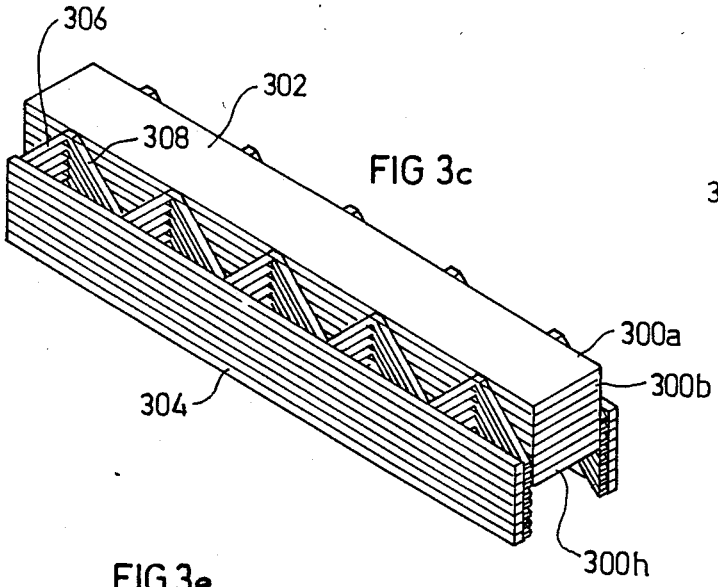
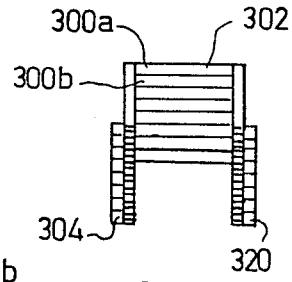
FIG 3d
FIG 3e
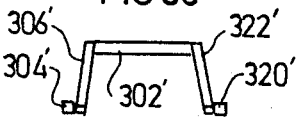

TRUSS MODULE FOR LOAD-BEARING STRUCTURES

RELATED APPLICATION

The present application is a continuation-in-part of my patent application Ser. No. 7/145,159, filed Jan. 19, 1988, now U.S. Pat. No. 4,827,688, and relates to truss modules for load-bearing structures, and particularly to modular constructional elements and bridge constructions utilizing the truss described in that patent application.

BACKGROUND OF THE INVENTION

My above-cited patent application Ser. No. 07/145,159 describes a truss comprising a first longitudinally-extending bar extending along one side of the truss, a second longitudinally-extending bar extending along the opposite side of the truss, and a plurality of transversely-extending bars joined at longitudinally-spaced points to the first and second longitudinally-extending bars. The truss of that patent application is characterized in that the transversely-extending bars are all joined to the first and second longitudinally-extending bars to occupy a first plane, the first longitudinally-extending bar is disposed in a second plane laterally of the first plane on one side of the transversely-extending bars, and the second longitudinally-extending bar is disposed in a third plane laterally of the first plane on the other side of the transversely-extending bars. The transversely-extending bars are disposed in a repeating pattern with tapered spaces in between, the arrangement being such as to permit a plurality of such trusses to be nested together with the transversely-extending bars of all the trusses disposed in the first plane, and the longitudinally-extending bars of all the trusses disposed in the second and third planes, respectively.

A major advantage of the truss structure of the above-cited patent application is that it permits a plurality of such trusses to be nested together to occupy a minimum volume for storage, handling and transportation. Another advantage is that it also permits such structures to serve as modular elements for constructing a truss framework of any desired strength by securing together a plurality of such trusses in various geometrical combinations while in a nesting relationship.

BRIEF SUMMARY OF THE PRESENT INVENTION

An object of the present invention is to provide a truss module for load-bearing structures, and particularly to a modular constructional element including the above-described basic truss for constructing various load-bearing structures, especially bridges, roofs, floors, and solar collector surfaces.

According to the invention of the present application, the first longitudinally-extending bar of the above-described truss structure has a substantial width in the plane of the respective bar to serve as a deck member in a construction, such as a bridge, utilizing a plurality of such modular elements.

According to another feature of the present invention, the modular constructional element further includes an end bar joined at a right angle to the second longitudinally-extending bar parallel to the respective edge of the deck member and connected thereto by a plurality of further transversely-extending bars.

According to additional features of the present invention, the modular constructional element further includes a third longitudinally-extending bar extending at the opposite side of the deck member parallel to and coplanar with the second longitudinally-extending bar and secured thereto by a plurality of further transversely-extending bars. The modular constructional element may further include an end bar joined to each of the two opposite ends of the second and third longitudinally-extending bars parallel to the respective edges of the deck member by a plurality of further transversely-extending bars.

The invention also provides a load-bearing structure, particularly a bridge, constructed with a plurality of the above-described modular elements, the load-bearing structure further including securing means for securing the modular elements together with the deck members of all the modular elements occupying substantially the same plane. When constructed as a bridge, the second and third longitudinal-extending bars in the modular element at the opposite ends of the bridge converge towards the respective deck members such that the latter deck members form ramps at the opposite ends of the bridge. Such modular constructional elements are self-nesting, and thereby decrease the volume for shipping, storing and handling; and they may also obviate the need for separate containers. These advantages make them particularly suitable for constructing prefabricated bridges and similar load-bearing structures, such as roofs, floors, and platforms.

Further features and advantages of the invention will be apparent from the description below.

BRIEF DESCRIPTION OF THE DRAWINGS

The invention is herein described, by way of example only, with reference to the accompanying drawings, wherein:

FIGS. 1*a* and 1*b* are three-dimensional and front views, respectively, of one form of modular constructional element in accordance with the present invention;

FIGS. 1*c* and 1*d* are three-dimensional and front views, respectively, illustrating a plurality of the modular elements of FIGS. 1*a* and 1*b* in a stack relationship;

FIGS. 2*a*–2*d*, 3*a*–3*d*, 4*a*–4*d* and 5*a*–5*d* are views, corresponding to those of FIGS. 1*a*–1*d*, illustrating further forms of modular constructional elements in accordance with the present invention, FIG. 3*e* illustrating a modification in the element of FIGS. 3*a*–3*d*;

DESCRIPTION OF PREFERRED EMBODIMENTS

Figure 4A:
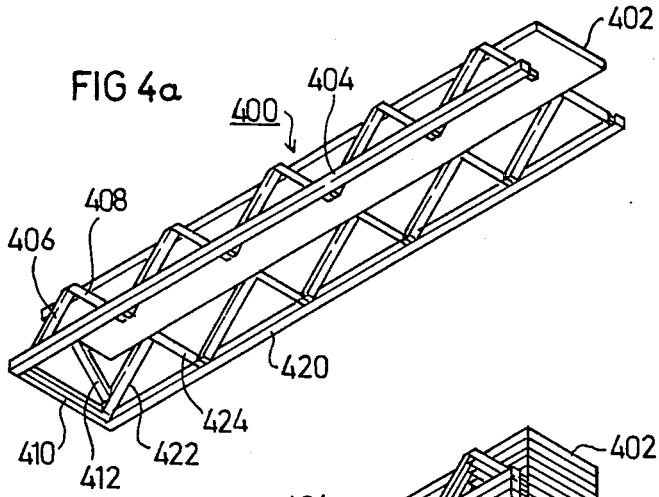

The modular constructional element illustrated in FIGS. 1*a* and 1*b*, and therein generally designated 100, includes the basic truss structure described in the above-cited application Ser. No. 07/145,159, now U.S. Pat. No. 4,827,688 namely a first longitudinally-extending bar 102 extending along one side of the truss, a second longitudinally-extending bar 104 extending along the opposite side of the truss and a plurality of transversely-extending bars 106, 108 joined at longitudinally-spaced points to bars 102 and 104. The transversely-extending bars 106, 108 occupy a first plane; longitudinally-extending bar 102 occupy a second plane laterally of the plane of bars 106, 108 on one side of those bars; and longitudinally-extending bar 104 occupy a third plane laterally of the plane of bars 106, 108 on the opposite side of those bars. The transversely-extending bars 106, 108 are disposed in a repeating pattern with tapered spaces in between, whereby a plurality of such trusses may be nested together with the transversely-extending bars 106, 108 occupying in the first plane, and all the longitudinally-extending bars 102 and 104 occupying the second and third planes, respectively.

Further details of the construction of such a truss, the advantages provided by it, and variations in its structure, are disclosed in the above-cited patent application Ser. No. 07/145,159, now U.S. Pat. No. 4,827,688, which is hereby incorporated by reference.

According to the invention of the present application, one of the longitudinally-extending bars, namely bar 102, is provided with a substantial width in the plane of the bar, thereby enabling the modular element to serve as a deck member in a load-bearing construction, particularly a bridge, utilizing a plurality of such modular elements. As shown particularly in FIGS. 1*c* and 1*d*, a plurality of such modular elements , therein designated 100*a*–100*h*, may be nested together, to thereby substantially decrease the volume for shipping, storing and handling such modular elements. Such modular elements when nested together also obviate the need for separate containers for enclosing the modular elements, thereby further decreasing the overall volume, as well as the cost, when shipping, storing or handling those elements.

FIGS. 2*a* and 2*b* illustrate a modular constructional element 200 of basically the same structure as described above with respect to FIGS. 1*a*–1*d*, including a pair of longitudinally-extending bars 202, 204 joined by a plurality of transversely-extending bars 206, 208, wherein the longitudinally-extending bar 202 is extended in width so as to serve as a deck element. The modular element in FIGS. 2*a* and 2*b*, however, further includes an end bar 210 joined at a right angle to longitudinally-extending bar 204 parallel to the respective edge of deck element 202 and connected thereto by a plurality of further bars 212, 214. Such modular elements may also be stacked in nesting relationship as clearly shown by elements 200*a*–200*h* in FIGS. 2*c* and 2*d* for transportation, storage or handling.

FIGS. 3*a* and 3*b* illustrate a modular constructional element 300 corresponding to that of FIGS. 1*a* and 1*b*, including deck member 302 joined to longitudinally-extending bar 304 by a plurality of transversely-extending bars 306, 308. The modular element of FIGS. 3*a*–3*d*, however, further includes a third longitudinally-extending bar 320 extending at the opposite side of the deck member 302 parallel to and coplanar with the longitudinally-extending bar 304, and secured to the deck member by a plurality of further bars 322, 324. This construction thus forms an omega-shaped profile, as shown particularly in FIG. 3*b*, and is also self-nesting as shown by elements 300*a*–300*h* in FIGS. 3*c* and 3*d*.

As shown in FIG. 3*b*, the spacing of the inner faces of the two longitudinally-extending bars 304 and 320 is equal to the width of the deck member 302 plus the thickness of their respective transversely-extending bars 306, 308 and 322, 324, to define right-angle connections between bars 304, 320 and the deck member 302. As shown in FIGS. 3*c* and 3*d* this permits the modular elements to be stacked in nesting relationship. However, the stacking may be facilitated by making the connections between the two longitudinally-extending bars 304, 320 at a slight incline. The latter is illustrated in the modification of FIG. 3*e*, wherein it will be seen that the spacing of the inner faces of the longitudinally-extending bars 304', 320' is slightly greater than the width of the deck member 302' plus the thicknesses of their respective transversely-extending bars, e.g., 306' and 322', to facilitate the stacking of the modular elements in nesting relationship. It will be appreciated that similar slopes can be applied to the other described embodiments.

Figure 4B:
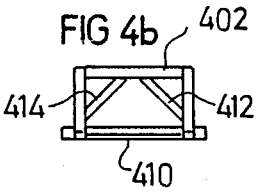
Figure 4D:
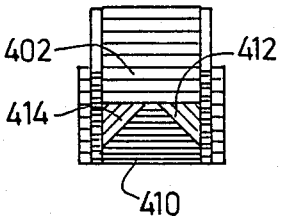
Figure 4C:
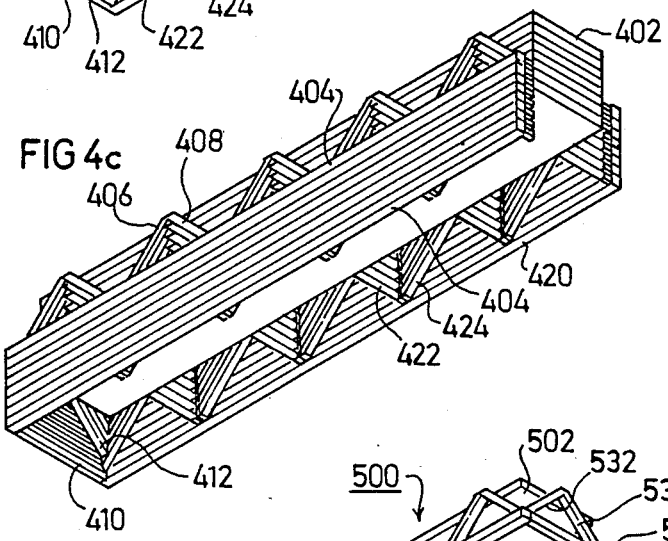

FIGS. 4*a* and 4*b* illustrate a modular constructional element 400 including a longitudinally-extending deck member 402 joined to a longitudinally-extending bar 404 on one side by a plurality of transversely-extending bars 406, 408, and to another longitudinally-extending bar 420 on the opposite side by a plurality of transversely-extending bars 422, 424, similar to the construction described above with respect to FIGS. 3*a*–3*d*. In the modular element of FIGS. 4*a* and 4*d*, however, there is an end bar 410 joined at a right angle to one end of the two longitudinally-extending bars 404, 420 parallel to the respective edge of the deck member 402 by a plurality of further bars 412, 414, similar to the structure described above with respect to FIGS. 2*a* and 2*b*. As shown ny elements 400*a*–400*h* in FIGS. 4*c* and 4*d*, such modular elements are also self-nesting.

Figure 5B:
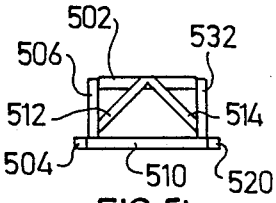
Figure 5A:
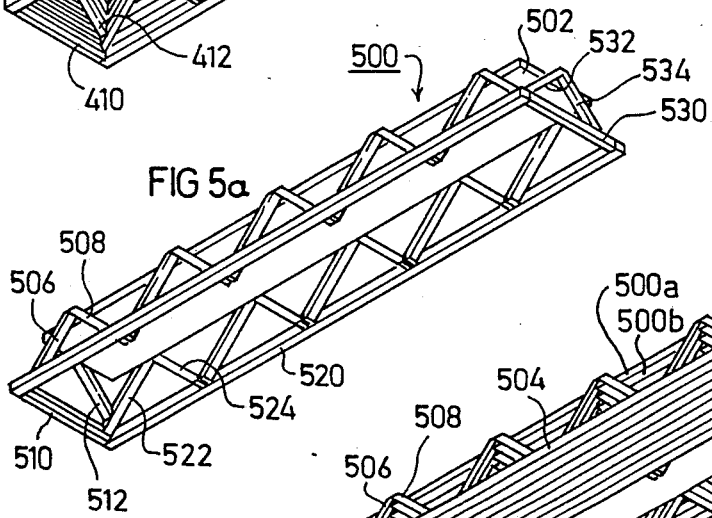
Figure 5C:
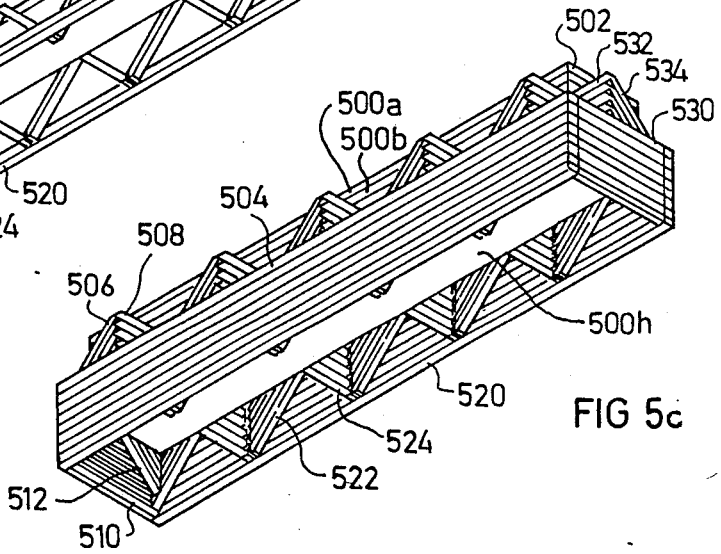
Figure 5D:
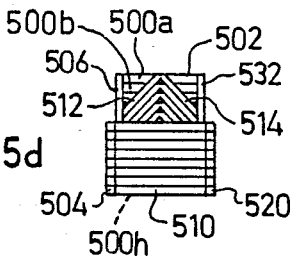

FIGS. 5*a* and 5*b* illustrate a modular element 500 similar to that of FIGS. 4–4*d*, to include a longitudinally-extending bar 504 joined at one side to the deck member 502 by a plurality of transversely-extending bars 506, 508, and a second longitudinally-extending bar 520 joined to the opposite side of deck member 502 by a plurality of transversely-extending bars 522, 524, as described above with respect to FIGS. 3*a*–3*d* and 4*a*–4*d*. In the modular element of FIGS. 5*a*–5*d*, however, there is an end bar 510, 530, joined at a right angle to each of the two opposite ends of bars 504 and 520, parallel to the respective edges of the deck member 502, by a plurality of transversely-extending bars 512, 514 and 532, 534. As shown by elements 500*a*–500*h* in FIGS. 5*c* and 5*d*, a plurality of such modular elements may also be stacked in nesting relationship.

Figure 6A:
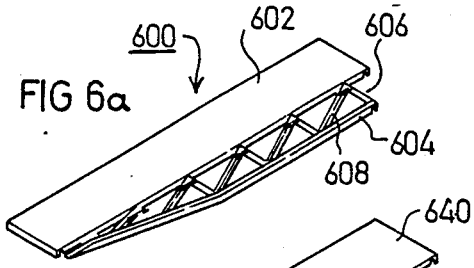
FIG. 6*a* is a three-dimensional view illustrating a single modular element constructed as an element of a ramp or a bridge.
Figure 6B:
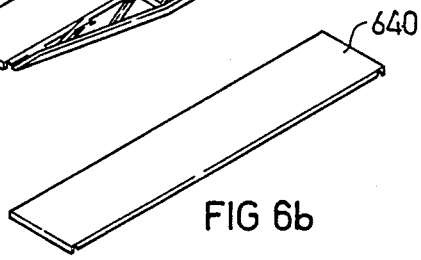
FIG. 6*b* illustrates a single deck member also used as a modular element.
Figure 6C:
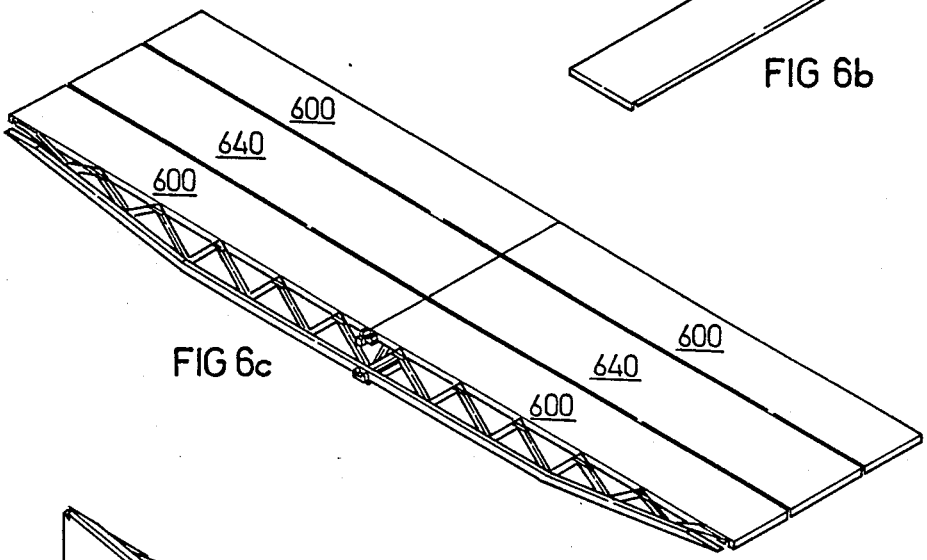
FIG. 6*c* illustrates a plurality of elements according to FIGS. 6*a* and 6*b* assembled in the form of a short bridge.
Figure 7A:
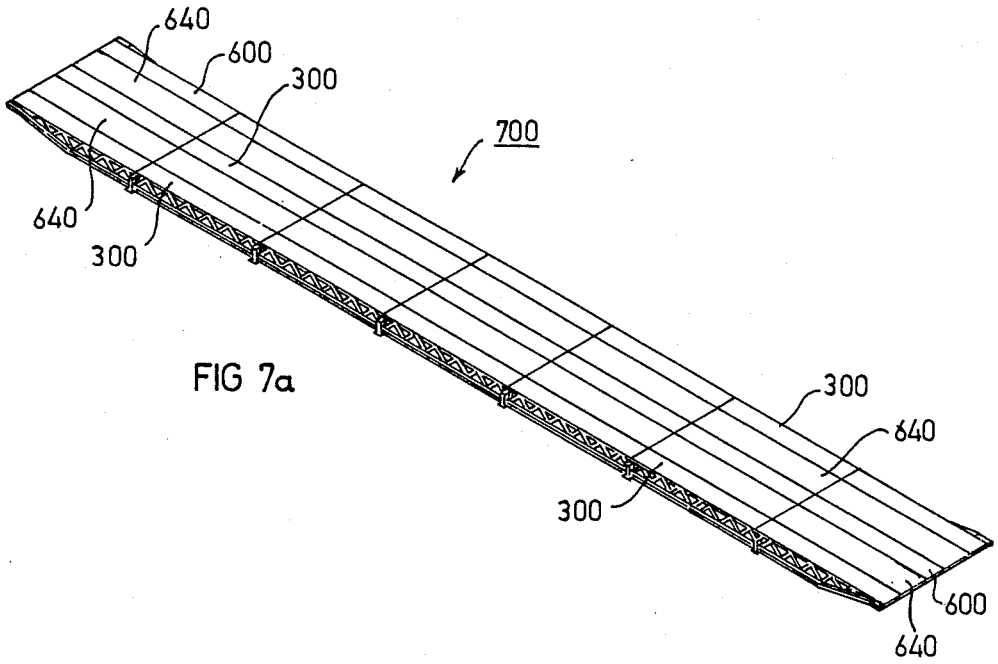
FIG. 7*a* illustrates a long bridge constructed in accordance with a plurality of the above-described modular constructional elements.

FIG. 6*a* illustrates a modular element, generally designated 600, particularly useful for constructing a simple bridge as illustrated in FIG. 6*c*, or the ramp end of a more complicated bridge as illustrated in FIG. 7*a*. Thus, the ramp element illustrated in FIG. 6*a* includes a deck member 602 joined to longitudinally-extending bars (e.g., 604) at its opposite sides by a plurality of transversely-extending bars (e..g, 606, 608), similar to the construction illustrated in FIGS. 3*a*–3*d*. In this case, however, the longitudinally-extending bars (e.g., 604)

converge towards the deck member 602 such that a plurality of such modular elements may be used for forming a ramp at the opposite ends of the bridge.

The simple bridge illustrated in FIG. 6c includes four modular elements 600, each as illustrated in FIG. 6a, plus two plain deck members 640, each as illustrated in FIG. 6b, each of the deck members being interposed between a pair of the modular elements 600. Modular elements 600 and the deck member 640 are assembled together by the use of transverse connecting trusses, generally designated 650, and more particularly illustrated in FIGS. 6d–6f.

Figure 6D:
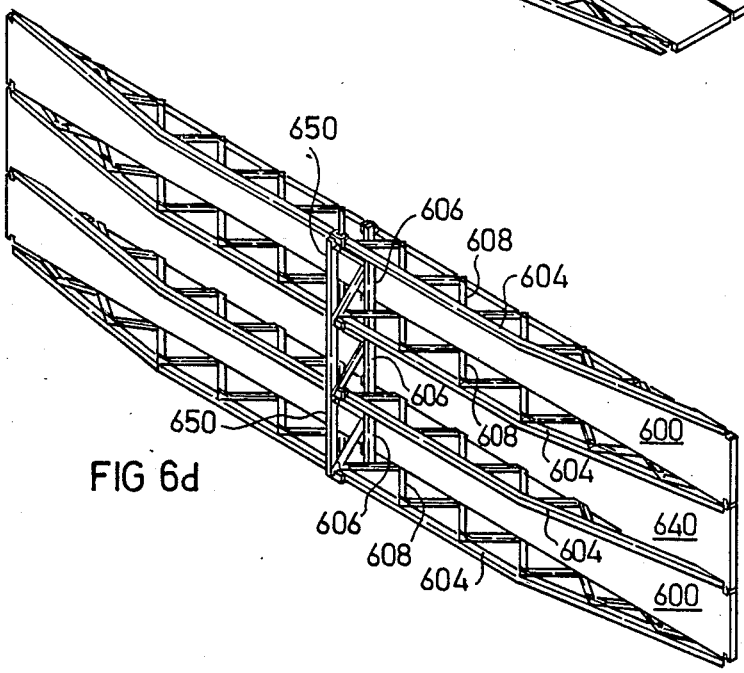
FIG. 6*d* illustrates the underside of the bridge assembly of FIG. 6*c*.
Figure 6E:
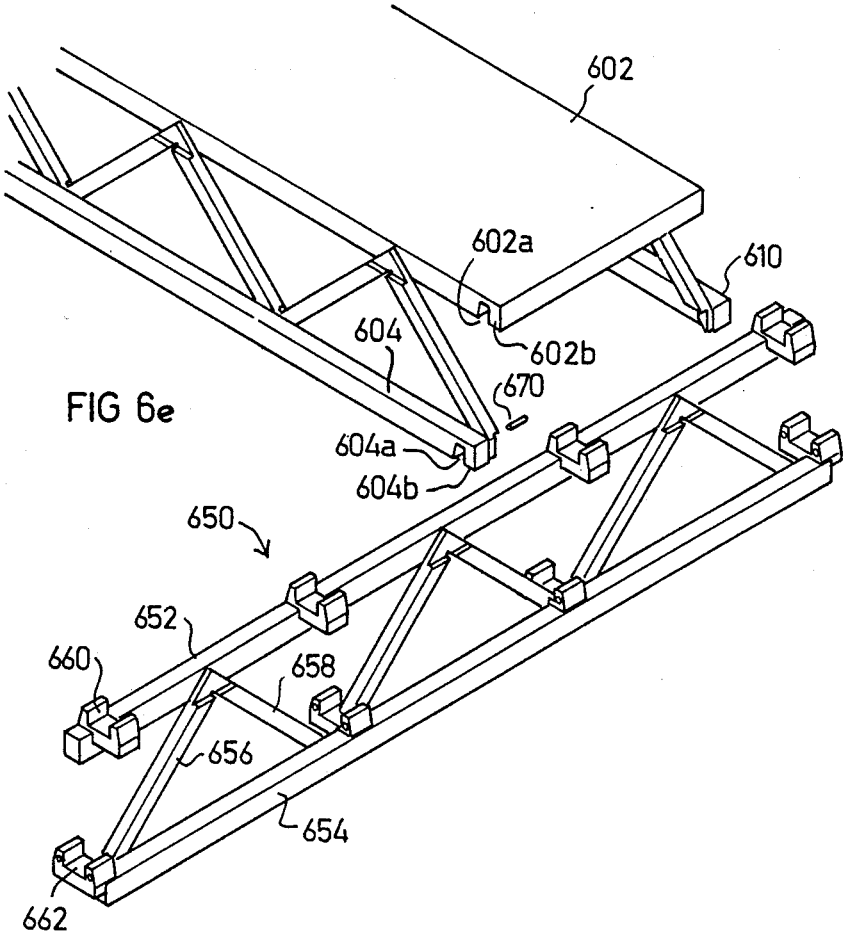
FIG. 6*e* illustrates the transverse connecting truss in the bridge assembly of FIG. 6*d*.
Figure 6F:
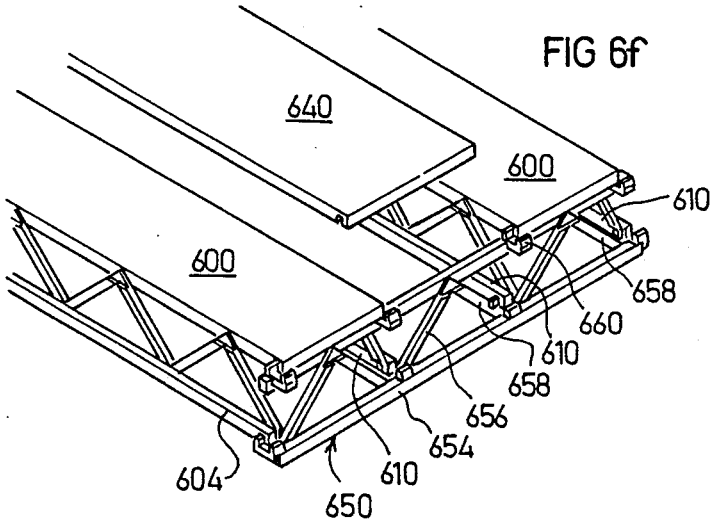
FIG. 6*f* illustrates the manner in which the transverse connecting truss of FIG. 6*e* secures together a plurality of modular truss members and deck members to form the bridge assembly.

Thus, as shown in FIGS. 6d–6f, the transverse connecting truss 650 includes a pair of parallel bars 652, 654 joined together by crossbars 656, 658. Each of the parallel bars 652, 654 is formed with a notched element 660, 662 adapted to receive ribs formed at the ends of the modular elements used in assembling the bridge.

Thus, each deck member (i.e., deck member 602 of each modular element 600 or the separate deck member 640) is formed with a notch 602a adjacent its end, to define a rib 602b at its end. Ribs 602b of the two adjacent modular elements secured by the transverse connecting truss 650 are received within notches 660 of connecting truss bar 652. Each rib occupies one-half the width of each notch, and both ribs are secured within the notch of the connecting bar by pins or fasteners, such as shown at 670 in FIG. 6e. The two longitudinally-extending bars 604, 610 of the modular element 600 are similarly formed with notches 604a, 610a, to define ribs 604b, 610b at their ends, and such ribs of two adjacent modular elements are received within the notched elements 662 of the lower connecting truss bar 654, where they are secured by pins or fasteners 670. In this manner, the transverse connecting trusses 650 may be applied in a quick and facile manner to assemble the modular elements 600, as well as of any of the other types of modular elements 100–500 and deck members 640, as described earlier, in any desirable combination according to the structure to be erected.

FIG. 6f illustrates the use of the transverse connecting trusses 650 for assembling a structure of three-unit width, such as the bridge illustrated in FIGS. 6c and 6d, to include, for each unit length, two modular elements 600 stradlling a deck member 640.

FIG. 7a illustrates a longer bridge 700 constructed with a plurality of the above-described modular units, namely with fifteen omega-units 300 (FIG. 3a), six ramp units 600 (FIG. 6a), and fourteen deck members 640 (FIG. 6b). Thus, each of the two opposite ends of the assembled bridge 700 includes three ramp elements 600 and two deck members 640, whereas the main section of the bridge 700 includes fifteen modular omega-units 300 and ten deck members 640, or a total of thirty-five units, to provide a bridge of five-unit width and seven-unit length.

Figure 7B:
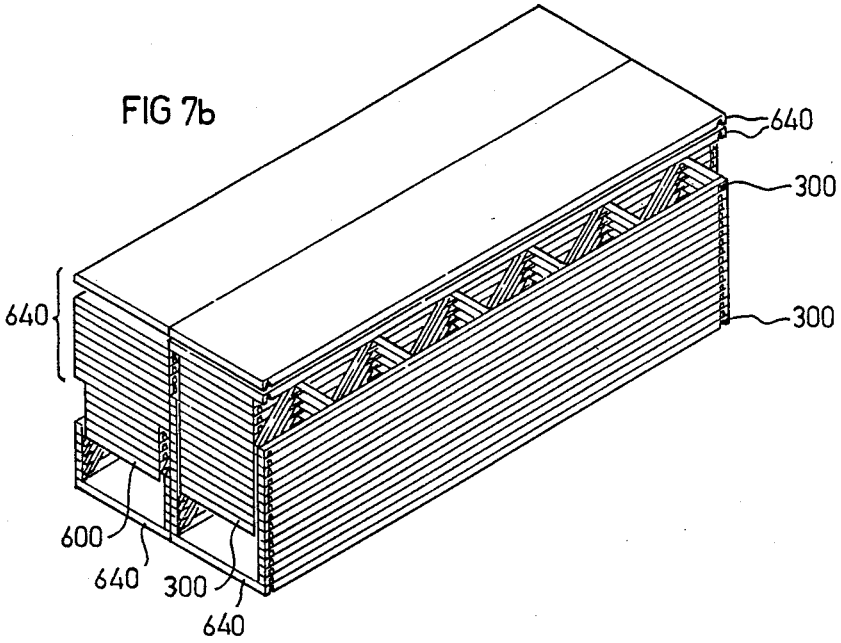
FIGS. 7*b* and 7*c* illustrates the opposite sides of the modular elements used for constructing the bridge of FIG. 7*a* assembled into a self-made container for shipping, handling, or storage purposes.
Figure 7C:
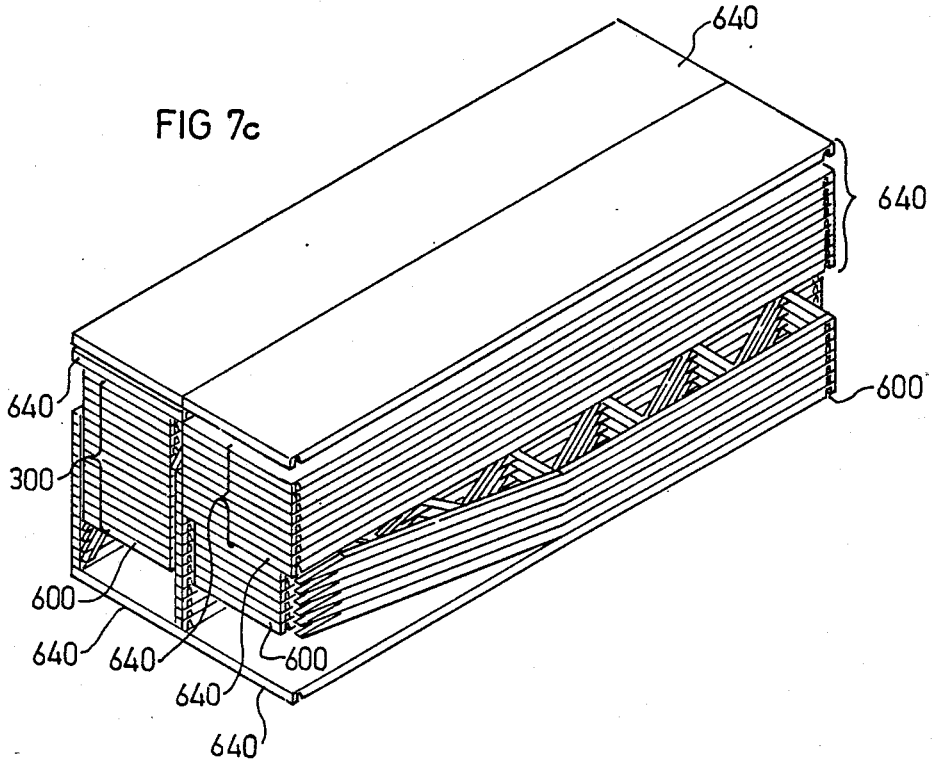

FIGS. 7b and 7c illustrate how these thirty-five units may be stacked in nesting relationship, with the units themselves defining their own containers, to miminize volume for purposes of storage, handling or transportation. For example, the thirty-five modular elements of the 140′×16′×8″ bridge illustrated in FIG. 7a can be packed in a single ISO size container of 20′×8′×8′; this is less than one-third the volume that would be required in a recent popular construction, and less than one-ninth the transportation volume required in older type bridges.

While the invention has been described with respect to several preferred embodiments, particularly useful for constructing a bridge, it will be appreciated that many variations in the construction of the modular units may be made, and that such modular units may be used for assembling other load-bearing structures, such as roofs, floors, platforms and the like. It is therefore to be appreciated that the described embodiments are set forth merely for purposes of example, and that many other variations, modifications and applications of the invention may be made.

What is claimed is:

1. A modular constructional element, comprising a truss including a first longitudinally-extending bar extending along one side of the truss, a second longitudinally-extending bar extending along the opposite side of the truss, and a plurality of transversely-extending bars joined at longitudinally spaced points to said first and second longitudinally-extending bars; said transversely-extending bars being joined to said first and second longitudinally-extending bars to occupy a first plane, said first longitudinally-extending bar being disposed in a second plane laterally of said first plane on one side of the transversely-extending bars, and said second longitudinally-extending bar being disposed in a third plane laterally of said first plane on the other side of the transversely-extending bars; said transversely-extending bars being disposed in a repeating pattern with tapered spaces in between, such as to permit a plurality of such trusses to be nested together; said first longitudinally-extending bar having a substantial width in the plane of the respective bar to serve as a deck member in a construction utilizing a plurality of such modular elements.

2. The modular constructional element according to claim 1, further including an end bar joined at a right angle to the second longitudinally-extending bar parallel to the respective edge of said deck member and connected thereto by a plurality of further transversely-extending bars.

3. The modular constructional element according to claim 1, further including a third longitudinally-extending bar extending at the opposite side of said deck member parallel to and coplanar with said second longitudinally-extending bar and secured to said opposite side of the deck member by a plurality of further transversely-extending bars.

4. The modular constructional element according to claim 3, further including an end bar joined at a right angle to one end of said second and third longitudinally-extending bars parallel to the respective edge of the deck member by a plurality of further transversely-extending bars.

5. The modular constructional element according to claim 3, further including an end bar joined at a right angle to each of the two opposite ends of said second and third longitudinally-extending bars parallel to the respective edges of the deck member by a plurality of further transversely-extending bars.

6. The modular constructional element according to claim 3, wherein the spacing of the inner faces of said second and third longitudinally-extending bars is equal to the width of said deck member plus the thickness of their respective transversely-extending bars to define right angle connections between the two longitudinally-textending bars and the deck member.

7. The modular constructional element according to claim 3, wherein the spacing of the inner faces of said second and third longitudinally-extending bars is slightly greater than the width of said deck member plus the thickness of their respective transversely-extending bars to define slightly inclined connections between the two longitudinally-extending bars and the deck member.

8. The modular constructional element according to claim 3, wherein said second and third longitudinally-extending bars converge towards said neck member.

9. A load-bearing structure including a plurality of the modular elements each according to claim 3, and further including securing means for securing said modular elements together with the deck members of all the modular elements occupying substantially the same plane.

10. The load-bearing structure according to claim 8, wherein the deck members and the second and third longitudinally-extending bars of the modular elements are formed with notches defining ribs at their ends; and wherein said securing means comprises a transverse connecting truss having a pair of parallel bars joined together by a plurality of crossbars, one of said parallel bars being formed with notches for receiving the ribs of the deck members of two adjacent modular elements, and the other of said parallel bars being formed with notches for receiving the ribs of the second and third longitudinally-extending bars of two adjacent modular elements.

11. The load-bearing structure according to claim 8, wherein the structure further includes a plurality of individual deck members each secured between adjacent modular elements by said securing means.

12. The load-bearing structure according to claim 8 constructed in the form of a bridge, wherein the second and third longitudinally-extending bars in the modular elements at the opposite ends of the bridge converge towards their respective deck members such that the latter deck members form ramps at the opposite ends of the bridge.

* * * * *